US006053749A

United States Patent [19]

Masuda et al.

[11] Patent Number: 6,053,749

[45] Date of Patent: Apr. 25, 2000

[54] SHIELDED CONNECTOR

[75] Inventors: Satoki Masuda; Hidehiko Kuboshima, both of Shizuoka, Japan

[73] Assignee: Yazaki Corporation, Tokyo, Japan

[21] Appl. No.: 09/108,324

[22] Filed: Jul. 1, 1998

[30] Foreign Application Priority Data

Jul. 2, 1997 [JP] Japan ..... 9-176951

[51] Int. Cl.[7] ..... H01R 4/66

[52] U.S. Cl. ..... 439/98; 439/610

[58] Field of Search ..... 439/188, 578–85, 439/603–610, 92, 95, 96, 97, 98, 99, 100, 101, 108

[56] References Cited

U.S. PATENT DOCUMENTS 5,691,506 11/1997 Miyazaki et al. ..... 174/65 R
5,722,841 3/1998 Wright ..... 439/98
5,890,929 4/1999 Mills et al. ..... 439/610

FOREIGN PATENT DOCUMENTS 1-112580 7/1989 Japan .
7-122330 5/1995 Japan .

*Primary Examiner*—Lincoln Donovan
*Attorney, Agent, or Firm*—Armstrong, Westerman, Hattori, McLeland & Naughton

[57] ABSTRACT

A shielded connector which can reduce production costs and prevent displacement of a shield wire is provided. The corrugated holder of the shielded connector is made up of a pair of half covers 36. Each half cover is provided with an outer cover and an inner cover. A case insertion chamber for a wire attachment case is formed between the outer cover and the inner cover. A wire stopper for the shield wire is formed at one end of the inner surface of the inner cover. A plurality of tube insertion grooves for a corrugated tube are formed at the other end of the inner surface of the inner cover. The outer cover is provided with a cover securing portion corresponding to the outer wall of the wire attachment case. The sheath of the shield wire is provided with a sheath holding ring for radially compressing the sheath.

14 Claims, 12 Drawing Sheets

SHIELDED CONNECTOR

BACKGROUND OF THE INVENTION

Field of the Invention

The present invention relates to a shielded connector having a shield wire used in electric system wiring for vehicles.

Related Art

FIG. 11 shows a shielded connector 1 disclosed in Japanese Utility Model Application Laid-Open No. 1-112580. The shielded connector 1 comprises a plurality of connector terminals 3 connected to the inner conductors 2*a* of a shield wire 2, and a metal connector housing 4 for accommodating the connector terminals 3.

A front-opening terminal receiving chamber 4*a* into which the connector terminals 3 are inserted is provided to the front of the connector housing 4. A securing chamber 4*b* for the shield wire 2 is formed on the rear of the terminal receiving chamber 4*a*.

The edge portion of the shield wire 2 is peeled, and in the vicinity of the peeled portion, a rubber or plastic tube 5 is placed on a sheath 2*b*. The tube 5 extends to the outside surface of the connector housing 4. The shield wire 2 is screwed to the securing chamber 4*b* by a clamp 6 over the tube 5. In FIG. 11, the reference numeral 2*c* indicates a shielding layer that constitutes the shield wire 2.

In the prior art, however, the screwing force of the clamp 6 for the shield wire 2 is absorbed by the tube 5, resulting in inadequate fastening of the shield wire 2. Because of this, if the shield wire 2 is pulled without the connector housing 4 being held by hand in an attempt to disengage the shielded connector 1 from a mating connector (not shown), a gap is caused between the sheath 2*b* and the shielding layer 2*c*.

A shielded connector for vehicles needs to have a waterproof structure, where appropriate, to prevent undesirable conditions in case washing water enters the connector housing during car washing or the like. The following waterproof structure, which employs a rear cover holder for the connector, is widely known.

FIG. 12 shows a rear holder cover 11 disclosed in Japanese Patent Application Laid-Open No. 7-122330. The rear holder cover 11 comprises a flat rear holder 13 to be inserted into a connector housing 12, half covers 14*a* and 14*b*, and hinges 15 which unitarily connect the rear holder 13 and the half covers 14*a* and 14*b*.

The half covers 14*a* and 14*b* are symmetrical. The half cover 14*b* is provided with a cover holding protrusion 16*a* for holding the half cover 14*a*, and cover holding protrusion receiving holes 16*b*. Likewise, the half cover 14*a* is provided with a cover holding protrusion 16*c* for holding the half cover 14*b*, and cover holding protrusion receiving holes 16*d*. The half covers 14*a* and 14*b* are provided with securing holes 17 corresponding to a plurality of securing protrusions 12*a* formed on the connector housing 12, and they are also provided with a securing grooves 19 (shown in FIG. 13) for securing a corrugated tube 18 (shown in FIG. 13).

Attaching the rear holder cover 11 includes the steps of: engaging the rear holder 13 with the connector housing 12; rotating the half covers 14*a* and 14*b* via the hinges 15 in the direction of the arrows P in FIG. 13; engaging the cover holding protrusions 16*a* and 16*c* with the cover holding protrusion receiving holes 16*b* and 16*d*, respectively; securing the corrugated tube 18 accommodating a wire (not shown) into the securing groove 19; and engaging the securing protrusions 12*a* with the securing holes 17. The rear holder cover 11 is thus unitarily engaged with the connector housing 12.

In the above prior art, however, as the rear holder 13 and the half covers 14*a* and 14*b* are unitarily formed via the hinges 15, the molding structure becomes very complicated. There is another problem that a large complicated molding device for improving productivity increases production costs.

SUMMARY OF THE INVENTION

The principal object of the present invention is to provide a shielded connector which can reduce production costs and prevent displacement of the sheath of the shield wire or the like.

In accordance with a first aspect of the present invention, the shielded connector comprises: a connector terminal connected to an end of a shield wire; a wire attachment case secured to the attachment opening of the casing of an electric equipment to accommodate and protect the shield wire; a corrugated holder attached to the wire insertion side of the wire attachment case; and a corrugated tube connected to the wire insertion side of the wire attachment case via the corrugated holder to protect the shield wire. The corrugated holder is made up of a pair of half covers facing to each other. Each of the half covers is provided with an outer cover and an inner cover. A case insertion chamber for the wire insertion side of the wire attachment case is formed between the outer cover and the inner cover. A wire stopper for the shield wire is formed at an end of the inner surface of the inner cover. A plurality of tube insertion grooves engaged with the corrugated tube are formed at the other end of the inner surface of the inner cover. The outer cover is provided with a cover securing portion corresponding to the outer wall of the wire attachment case.

In this structure, the half covers are engaged with the shield wire and the corrugated tube, and unitarily attached to the wire attachment case. The half covers are symmetrical, making the mold structure simple. Production costs can also be reduced, as the number of half covers obtained from one mold can be increased.

In accordance with a second aspect of the present invention, the sheath of the shield wire is provided with a sheath holding ring which radially compresses the sheath. Thus, displacement of the sheath can be prevented even if unexpected external forces are exerted on the shield wire.

In accordance with a third aspect of the present invention, the sheath holding ring has a small caulking portion and a large stopper with a step portion, and the open rim of the large stopper has a diameter large enough to interfere with the wire stopper of the corrugated holder. Even if the shield wire is displaced due to external forces exerted on it, the stopper is engaged with the wire stopper, thereby preventing sheath displacement.

In accordance with a fourth aspect of the present invention, a rubber stopper which can be engaged with the wire stopper is attached to the shield wire. In assembling the shielded connector, the rubber stopper can surely be inserted into the wire attachment case by the wire stopper. Thus, there is no trouble to insert the rubber stopper by hand, and workability can be improved.

In accordance with a fifth aspect of the present invention, the wire stopper is held between the sheath holding ring and the rubber stopper attached to the shield wire. Thus, the wire stopper can prevent displacement of the sheath and improve workability on the rubber stopper.

In accordance with a sixth aspect of the present invention, the wire stopper is made up of a plurality of protrusions situated at equal intervals and protruding toward the axis of the corrugated holder. Thus, the split-molding structure can be simplified, and the shield wire can be engaged with the edges of the protrusions as well as the half covers.

In accordance with a seventh aspect of the present invention, the wire stopper is a ring-like protrusion for holding the shield wire. Thus, the split-molding structure can be simplified, and the shield wire can be engaged with the top surface of the ring-like protrusion as well as the half covers.

In accordance with an eighth aspect of the present invention, the inner coating of the shield wire extends from the opening at the connector terminal connecting side of the wire attachment case, and the inner coating is provided with an inner coating holding ring having a flange which can interfere with the opening. Thus, even if the shield wire is moved due to unexpected external forces exerted on it, the inner coating holding ring is engaged with the wire attachment case to prevent displacement of the sheath.

In accordance with a ninth aspect of the present invention, the inner coating holding ring also serves as a stopper to prevent a shell member having electrical continuity to the braid of the shield wire from moving toward the connector terminal side of the wire attachment case. With this structure, displacement of the shell member can be prevented, and electrical contact failure can be avoided.

In accordance with a tenth aspect of the present invention, the inner coating holding ring is made of an insulating material. Thus, a short circuit between the connector terminal and the shell member can be prevented.

In accordance with an eleventh aspect of the present invention, the shielded connector comprises: a connector terminal connected to an end of a shield wire; an inner case for accommodating and securing the connector terminal; an outer case covering the inner case and the end of the shield wire, and connected to a mating connector; a corrugated holder attached to the wire insertion side of the outer case; and a corrugated tube for protecting the shield wire connected to the wire insertion side of the outer case via the corrugated holder. The corrugated holder is made up of a pair of half covers facing to each other. Each of the half covers is provided with an outer cover and an inner cover. A case insertion chamber is formed between the outer cover and the inner cover at the wire insertion side of the outer case. A wire stopper for the shield wire is formed at one end of the inner surface of the inner cover. A plurality of tube insertion grooves to be engaged with the corrugated tube are formed at the other end of the inner surface of the inner cover. The outer cover is provided with a cover securing portion corresponding to the outer wall of the outer case.

In this structure, the half covers are engaged with the shield wire and the corrugated tube, and unitarily attached to the outer case. The half covers are symmetrical, which simplifies the split-molding structure. Since no large molding device is necessary to obtain a larger number of half covers from one mold, production costs can be reduced.

In accordance with a twelfth aspect of the present invention, the sheath of the shield wire is provided with a sheath holding ring for radially compressing it. Thus, even if unexpected external forces are exerted on the shield wire, displacement of the sheath can be prevented.

In accordance with a thirteenth aspect of the present invention, the sheath holding ring has a small caulking portion and a large stopper with a step portion, and the open rim of the stopper portion has a diameter large enough to interfere with the wire stopper of the corrugated holder. Thus, even if unexpected external forces are exerted on the shield wire, the stopper portion is engaged with the wire stopper, thereby preventing displacement of the sheath.

The above and other objects and features of the present invention will be more apparent from the following description taken in conjunction with the accompanying drawings.

DETAILED DESCRIPTION OF THE PREFERRED EMBODIMENTS

The following is a description of one embodiment of the present invention, with reference to the accompanying drawings.

Figure 1:
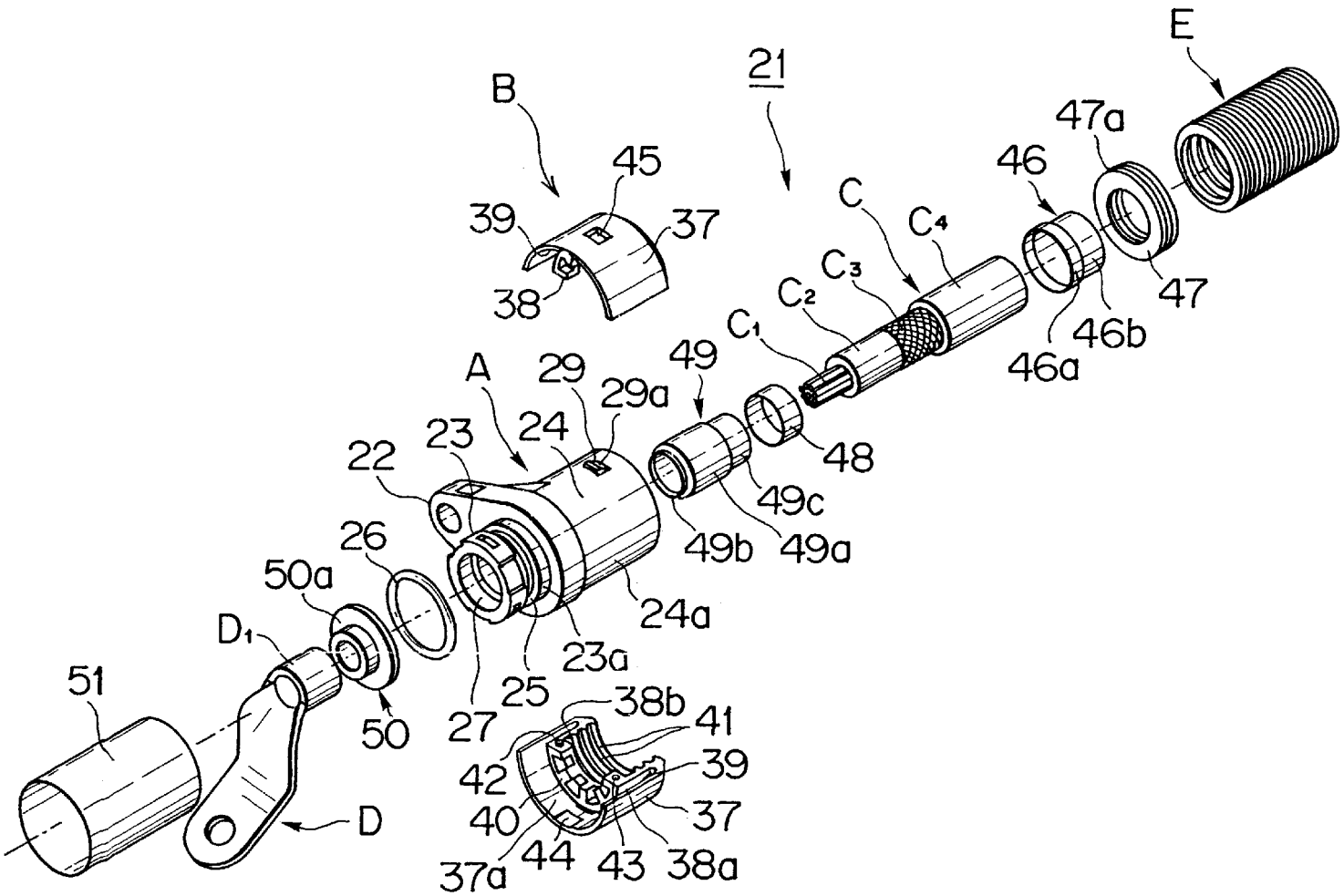
FIG. 1 is an exploded perspective view illustrating one embodiment of a shielding connector of the present invention.
Figure 2:
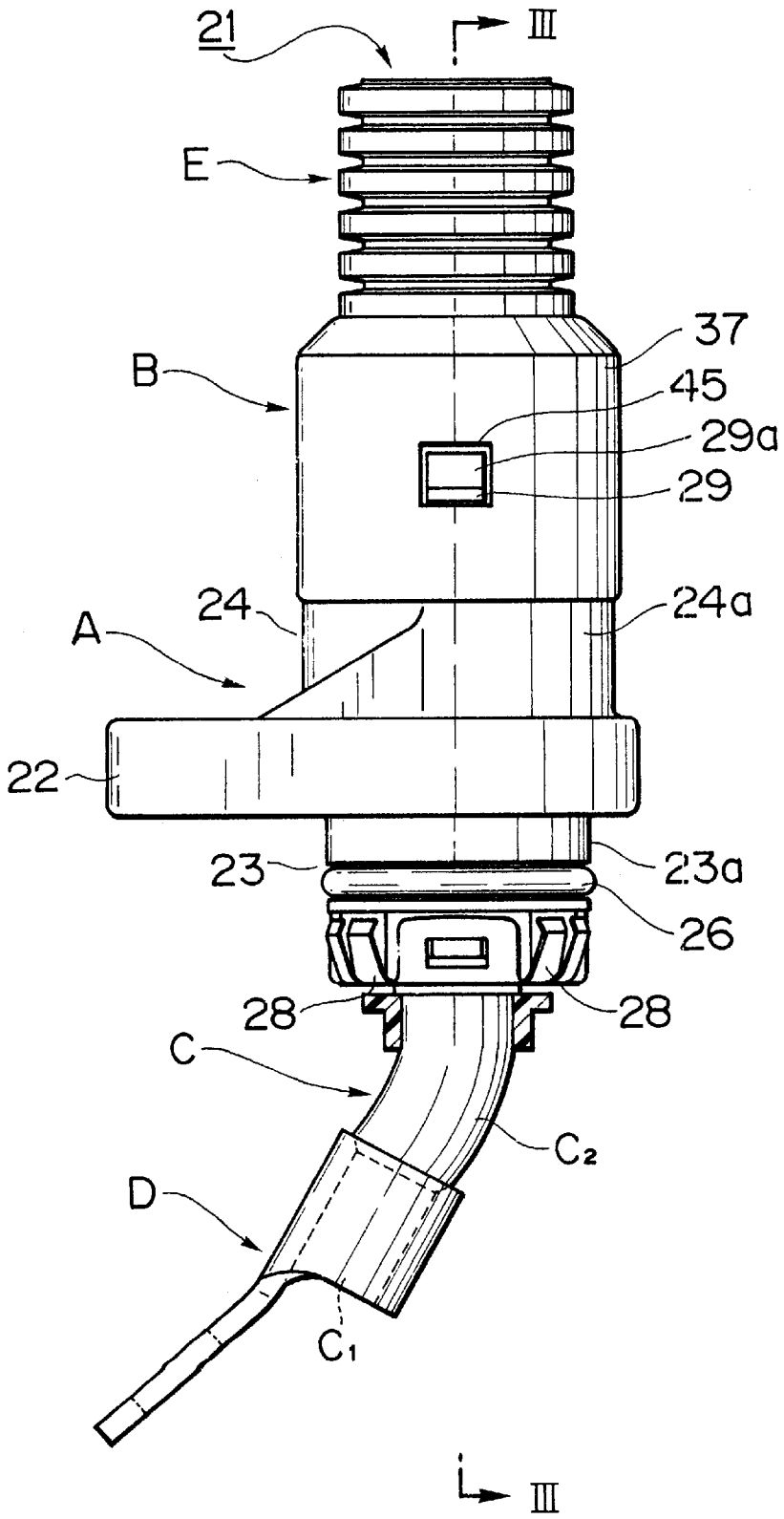
FIG. 2 is a front view of the shielding connector made up of the components shown in FIG. 1.
Figure 3:
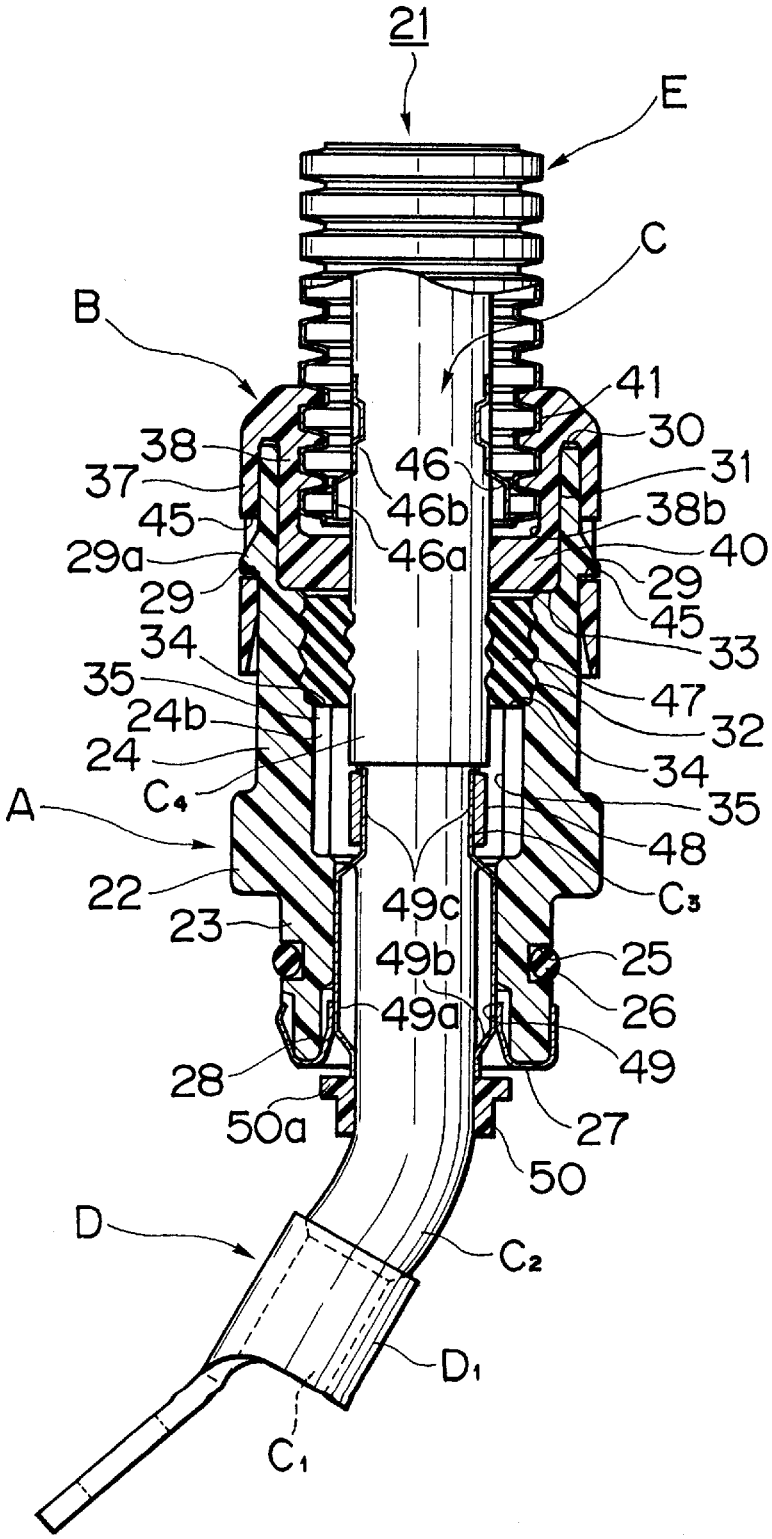
FIG. 3 is a sectional view of the shielding connector taken along the line III—III of FIG. 2.

In FIGS. 1 to 3, reference numeral 21 indicates a shielded connector used for the electric system wiring of an electric car. The shielded connector 21 comprises a wire attachment case A made of synthetic resin, a corrugated holder B also made of synthetic resin, a shield wire c, a connector terminal D, and a corrugated tube E.

The wire attachment case A is cylindrical with both ends open. An attachment portion 22 for a motor case (not shown) is provided in the mid section of the outer periphery wall. The front part of the attachment portion 22 is a small attachment cylinder 23 to be attached to the attachment opening of the motor case, and the rear part of the attachment portion 22 serves as a large case main body 24 for receiving the shield wire C.

A groove 25 (shown in FIGS. 1 and 3) is formed around the outer periphery wall 23*a* of the attachment cylinder 23, and a rubber seal ring 26 is placed in the groove 25. First shell members 28 (shown in FIGS. 2 and 3) formed by pressing and bending conductive metal thin plates are attached to the edge of the attachment cylinder 23, i.e., to a front opening 27 of the wire attachment case A. With the attachment portion 22 being secured by screwing, the wire attachment case A is mounted to the motor case.

A pair of fixed protrusions 29 facing to each other protrude from the mid section of the outer periphery wall 24*a*. Each of the fixed protrusions 29 is provided with a tapered face 29*a* extending toward the wire inserting end of the case main body 24, i.e., toward a rear opening 30 of the wire attachment case A, so that the corrugated holder B can be easily engaged thereto.

Meanwhile, the inside 24*b* of the case main body 24 is formed by a rear edge opening 30, the large holder engaging chamber 31 and a small rubber stopper engaging chamber 32 with a step 33. In the front of the rubber stopper engaging chamber 32, a plurality of protrusions 35 which extend in parallel with the axis of the wire attachment case A and have steps 34 as stoppers are provided at equal intervals.

Figure 4:
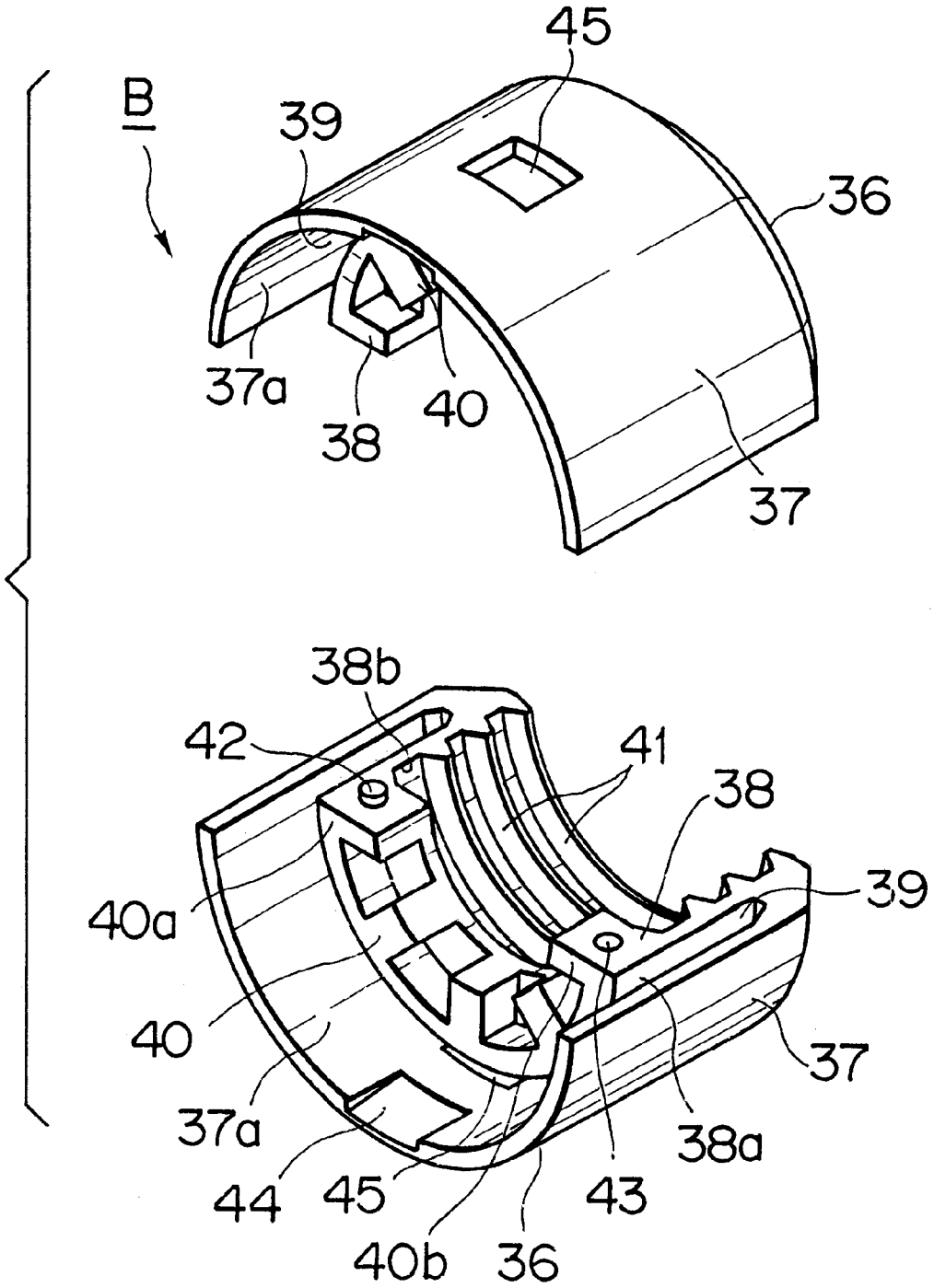
FIG. 4 is an enlarged perspective view of the corrugated holder of FIG. 1.
Figure 5A:
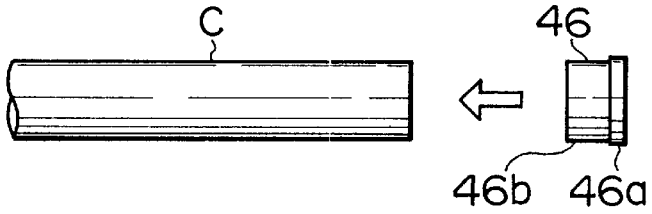
FIG. 5A shows the shielding wire of FIG. 1 before sheath a holding ring is attached to it.
Figure 5B:
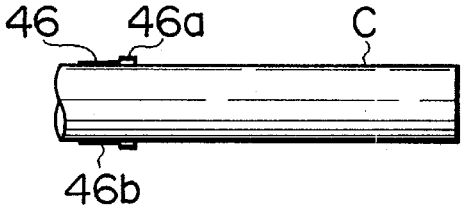
FIG. 5B shows the shielding wire with the sheath holding ring attached thereto.
Figure 5C:
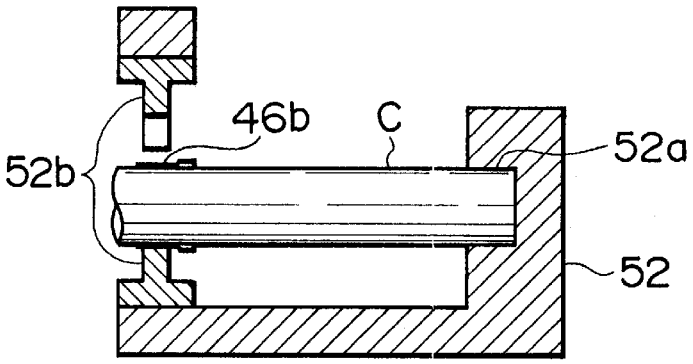
FIG. 5C shows the shielding wire secured to a caulking device before the sheath holding ring is caulked.
Figure 5D:
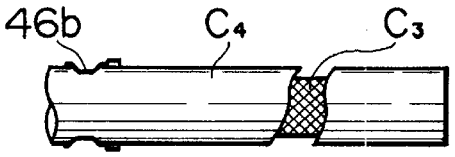
FIG. 5D shows the shielding wire with the caulked sheath holding ring.
Figure 5E:
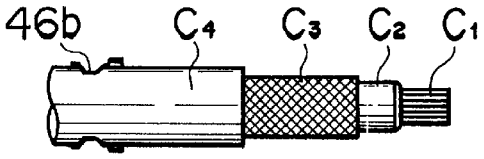
FIG. 5E shows the shielding wire whose end portion is peeled.

As shown in FIG. 4, the corrugated holder B is made up of a pair of half covers 36 facing to each other. Each of the half covers 36 is provided with an outer cover for the outer periphery wall 24*a* of the case main body 24, and an inner cover 38 to be received by the holder engaging chamber of the case main body 24. The outer cover 37 and the inner cover 38 are connected at the rear ends. The outer cover 37 of the first embodiment is made longer than the inner cover having a length relative to the depth of the holder engaging chamber. A case insertion chamber 39 for the rear opening 30 of the case main body 24 is formed between the inner periphery 37*a* of the outer cover 37 and the outer periphery of the inner cover 38.

A plurality of wire stopper protrusions 40 as wire stoppers are formed in the front of the inner periphery 38*b* of the inner cover 38 at equal intervals, and a plurality of tube insertion grooves 41 in the rear. Wire stopper protrusions 40*a* and 40*b* stand at both ends of the inner cover 38. A pin-like protrusion protrudes from the wire stopper protrusion 40*a*, while a protrusion receiving hole 43 is formed on the wire stopper protrusion 40*b*.

Meanwhile, the outer cover 37 has a tapered guide portion 44 for receiving the securing protrusion 29 at one end of the inner surface 37*a*. A rectangular securing hole 45 which serves as a cover securing portion is formed in the middle of the inner surface 37*a*.

As shown in FIG. 1, the shield wire C is made up of an inner conductor $C_1$, an inner coating $C_2$, a braid $C_3$, and a sheath $C_4$. After an assembling process (described later), the connector terminal D is connected to the inner conductor $C_1$ (see FIGS. 2 and 3), and the sheath $C_4$ is covered with the shield wire-protecting corrugated tube E (see FIG. 3). The shield wire C, the connector terminal D, and the corrugated tube E have the same structure as in the prior art.

In FIGS. 1 and 3, reference numeral 46 indicates a sheath holding ring to be attached to the shield wire. The sheath holding ring is made up of a large stopper portion 46*a* and a small caulking portion 46*b* with a step portion. The front rim of the stopper portion 46*a* has a diameter large enough to interfere with the inner surface of each wire stopper protrusion 40 of the corrugated holder B. Reference numeral 47 indicates a ring rubber stopper attached to the shield wire C. Reference numeral 48 indicates a braid holding ring, while reference numeral 49 indicates a second shell member formed by a conductive metal pipe or the like. The second shell member 49 has a large ring portion 49*a*, and small ring portions 49*b* and 49*c* are provided in the front and rear of the large ring portion 49*a* with steps. Reference numeral 50 indicates an inner coating holding ring attached to the inner coating $C_2$ of the shield wire C. A flange 50*a* is formed at the rear end of the inner coating holding ring 50. The inner coating ring 50 is made of an insulating material, such as Nylon 6-6 (trademark name) having heat resistance reinforced by glass fiber. Reference numeral 51 indicates a heat shrinkage tube (see FIG. 1) for the pressing portion $D_1$ of the connector terminal D.

Referring to FIG. 5, the following is a detailed description of the processing step for the shield wire C. First, the sheath holding ring 46 is set to an edge of the shield wire C (FIG. 5A). The sheath holding ring 46 is then inserted into the shield wire C from the side of the caulking portion 46*b* (FIG. 5B). The edge of the shield wire C is held by a holding portion 52*a* of a caulking device 52, and the caulking portion 46*b* is caulked with a die 52*b* (FIG. 5C). By doing so, the sheath $C_4$ and the braid $C_3$ are strongly bonded (FIG. 5D). The edge of the shield wire C is peeled by a jig (not shown) to expose the braid $C_3$, the inner coating $C_2$, and the inner conductor $C_1$, in that order (FIG. 5E). As the caulking portion 46*b* is caulked, the sheath $C_4$ is never displaced during the peeling process.

Figure 6:
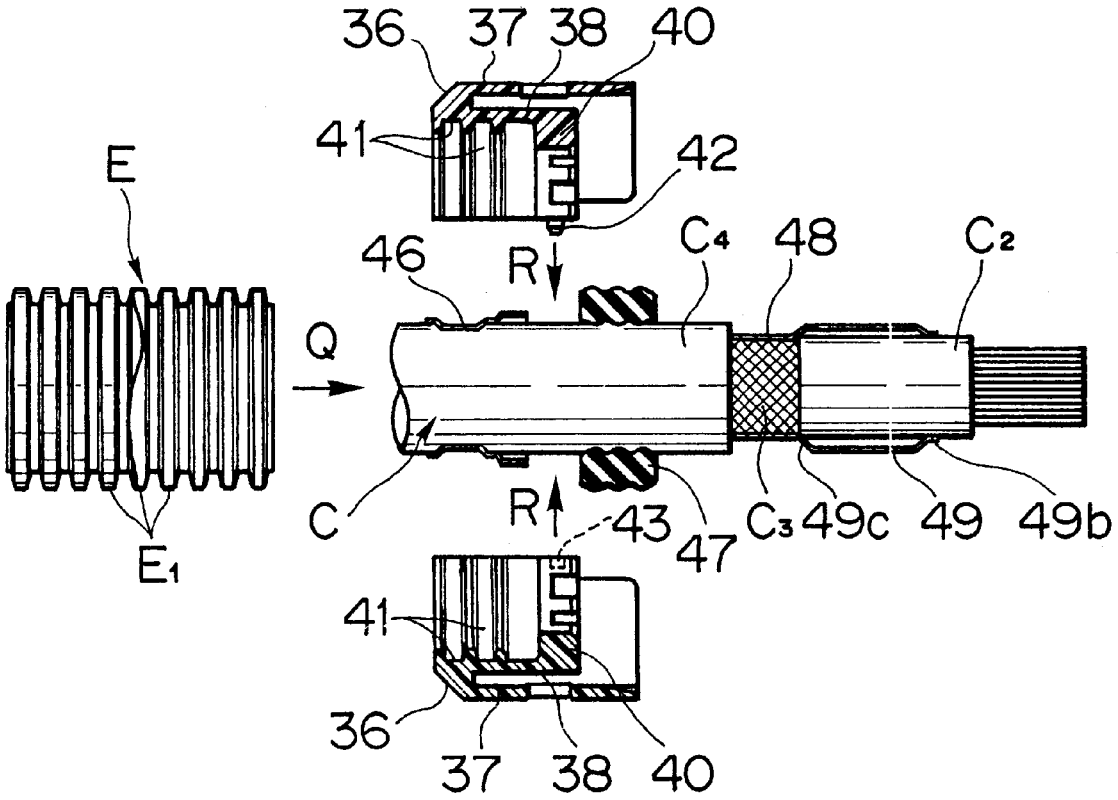
FIG. 6 shows the shielding wire of FIGS. 5A to 5E provided with a half cover.

Referring now to the FIGS. 6 to 9, the following is a detailed description of the assembling procedure of the shielded connector 21. As shown in FIG. 6, the rubber stopper 47 is inserted into the sheath $C_4$. Here, the rubber stopper 47 is preferably kept a distance from the sheath holding ring 46 by the thickness of each wire stopper protrusion 40 of each half cover 36. The rubber stopper 47, as well as the sheath holding ring 46, may be attached to the outer periphery of the shield wire C in the processing step for the shield wire C. Successively, the braid holding ring 48 is attached to the outer periphery of the braid $C_3$, and the rear-side small ring portion 49*c* of the second shell member 49 is inserted between the braid $C_3$ and the inner coating $C_2$. The front-side small ring portion 49*b* of the second shell member 49 is in contact with the inner coating $C_2$, thereby holding it.

The corrugated tube E is pulled onto the sheath holding ring 46 (in the direction indicated by the arrow Q in FIG. 6) so as to engage the half covers 36 over the both sides of the corrugated tube E (indicated by the arrow R in FIG. 6). Here, the convex walls $E_1$ of the corrugated tube E are inserted into the plurality of tube insertion grooves 41 of the inner cover 38, and the edges of the wire stopper protrusions 40 are engaged with the shield wire C. The pin-like protrusion 42 and the protrusion receiving hole 43 formed on the inner cover 38 are engaged with each other, and the half covers 36 unitarily form the corrugated holder B (see FIG. 7).

Figure 7:
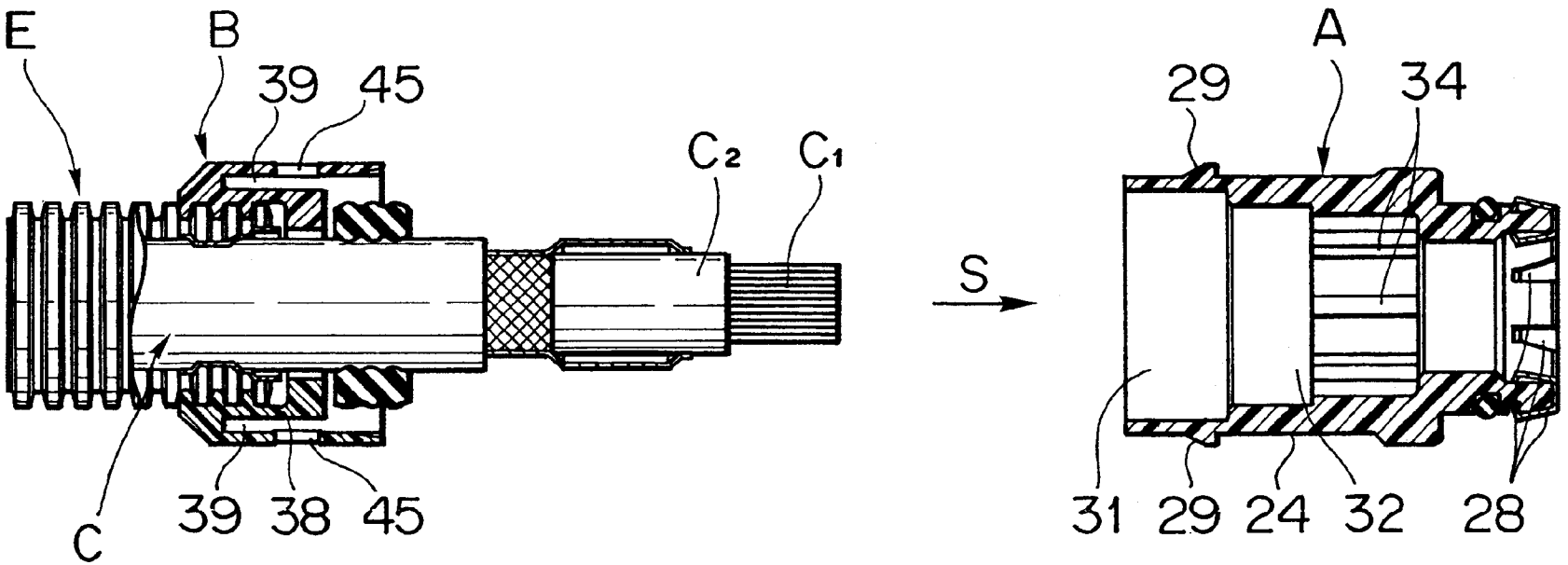
FIG. 7 shows a wire attachment case before engaged with the corrugated holder.
Figure 8:
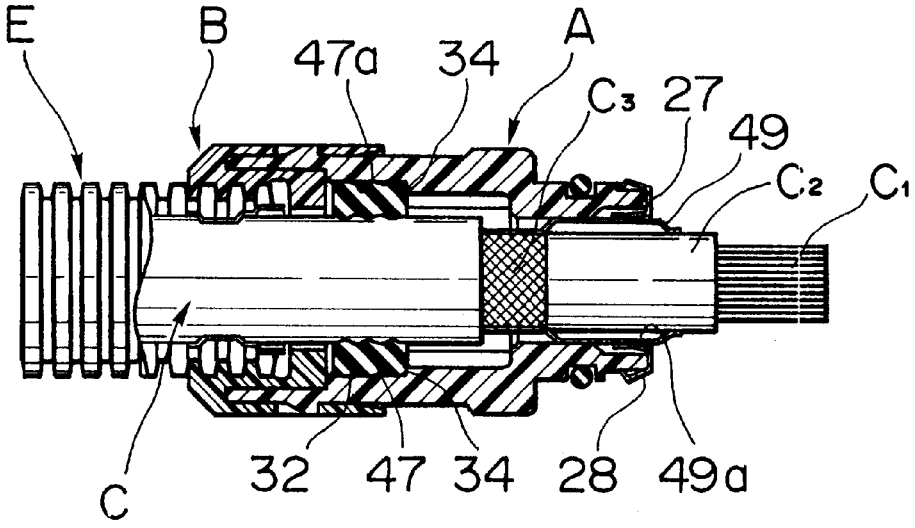
FIG. 8 shows the wire attachment case engaged with the corrugated holder.

As shown in FIG. 7, the corrugated holder B, with which the shield wire C and the corrugated tube E are engaged, is set to the wire attachment case A (in the direction indicated by the arrow S in FIG. 7). The case main body 24 is inserted into the case insertion chamber 39, and the inner cover 38 is then received by the holder engaging chamber 31. The securing protrusions 29 are engaged with the securing holes 45. Thus, the corrugated holder B is securely engaged with the wire attachment case A, as shown in FIG. 8.

In such condition, the shield wire C is attached such that the inner conductor $C_1$ and the inner coating $C_2$ protrude from the front-end opening 27 of the wire attachment case A. The rubber stopper 47 inserted into the wire attachment case A together with the shield wire C is engaged with the step 34, and the outer periphery surface 47*a* of the rubber stopper 47 is securely engaged with the rubber stopper engaging chamber 32. Meanwhile, the large ring portion 49*a* of the second shell member 49 is brought into contact with the first shell member 28, so that the braid $C_3$ becomes conductive with the outside.

Figure 9:
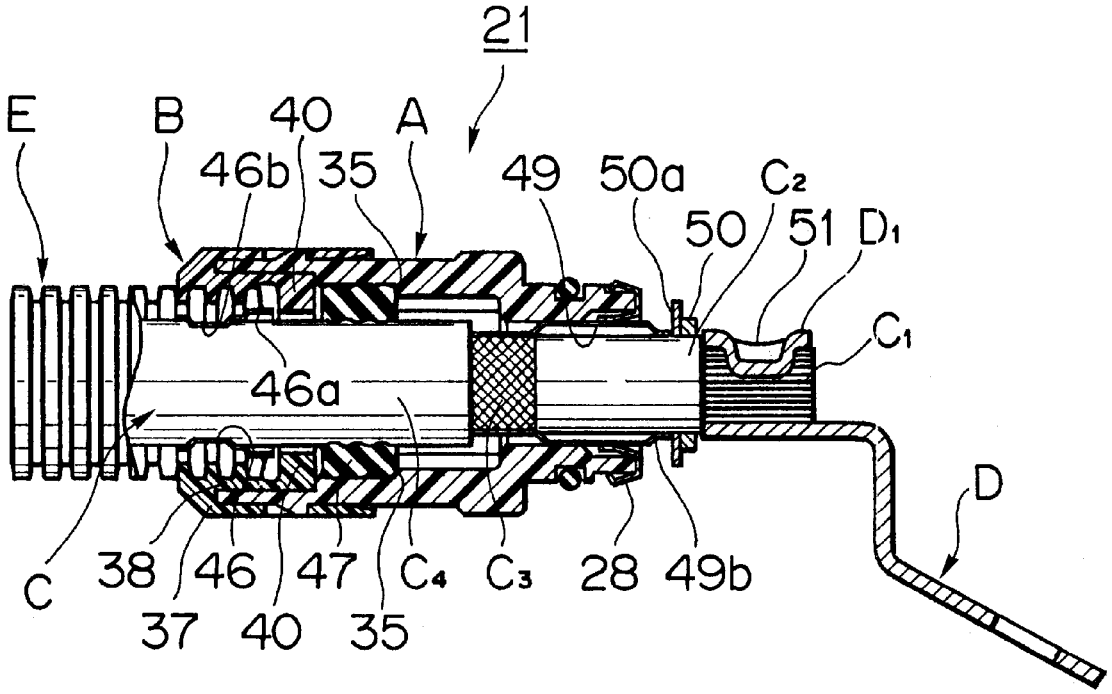
FIG. 9 shows the assembled shielding connector.

As shown in FIG. 9, the inner coating holding ring 50 is attached to the inner coating $C_2$ from the side of the flange 50*a*, so that it comes into contact with the small ring portion 49*b* of the second shell member 49. The inner coating holding ring 50 is secured to the inner coating $C_2$ by a conventional means such as adhesive. The connector terminal D is then pressed and attached to the inner conductor $C_1$, and the pressing portion $D_1$ is covered with the heat shrinkage tube 51. The heat shrinkage tube 51 shrinks by heat and protects the pressing portion $D_1$.

As described so far, in the first embodiment of the present invention, the sheath holding ring 46 is caulked to the shield wire C, so that the sheath $C_4$ strongly adheres to the braid $C_3$ and the like, and that displacement of the sheath $C_4$ can be prevented. Even if forces to pull the connector terminal D from the wire attachment case A are exerted on the shield wire C, the stopper portion 46*a* of the sheath holding ring 46 is engaged with the wire stopper protrusions 40, so that movement of the shield wire C is restricted, and displacement of the sheath $C_4$ and the like can be prevented. Furthermore, even if forces to press the connector terminal D onto the wire attachment case A are exerted on the shield wire C, the flange 50*a* of the inner coating holding ring 50 is engaged with the front-end opening 27 of the wire attachment case A, so that movement of the shield wire C is restricted, and displacement of the sheath $C_4$ and the like can be prevented.

The rubber stopper 47 is pushed by the outer surface of each wire stopper protrusion 40, and then inserted into the rubber stopper engaging chamber 32. This eliminates the trouble of pushing in the rubber stopper 47 by hand, and improves workability. The inner coating holding ring 50 also serves as a stopper for preventing the second shell member 49 from moving forward, and prevents the connector terminal D from coming into contact with the first shell member 28 or the second shell member 49 and causing a short circuit. The inner coating holding ring 50 further serves as a stopper for preventing the wire attachment case A from moving toward the connector terminal D.

Since the corrugated holder B is made up of the pair of half covers 36, the area occupied by the metal mold can be reduced, and the split-mold structure of the metal molding can be simplified. As a result, more half covers can be obtained without a large-type molding device. Accordingly, production costs can also be reduced. After the half covers 36 sandwich the corrugated tube E from both sides, the shielded connector 21 can be easily assembled by even a first-time assembling worker, because the assembling process includes only simple steps such as attaching the corrugated holder B to the wire attachment case A.

Figure 10:
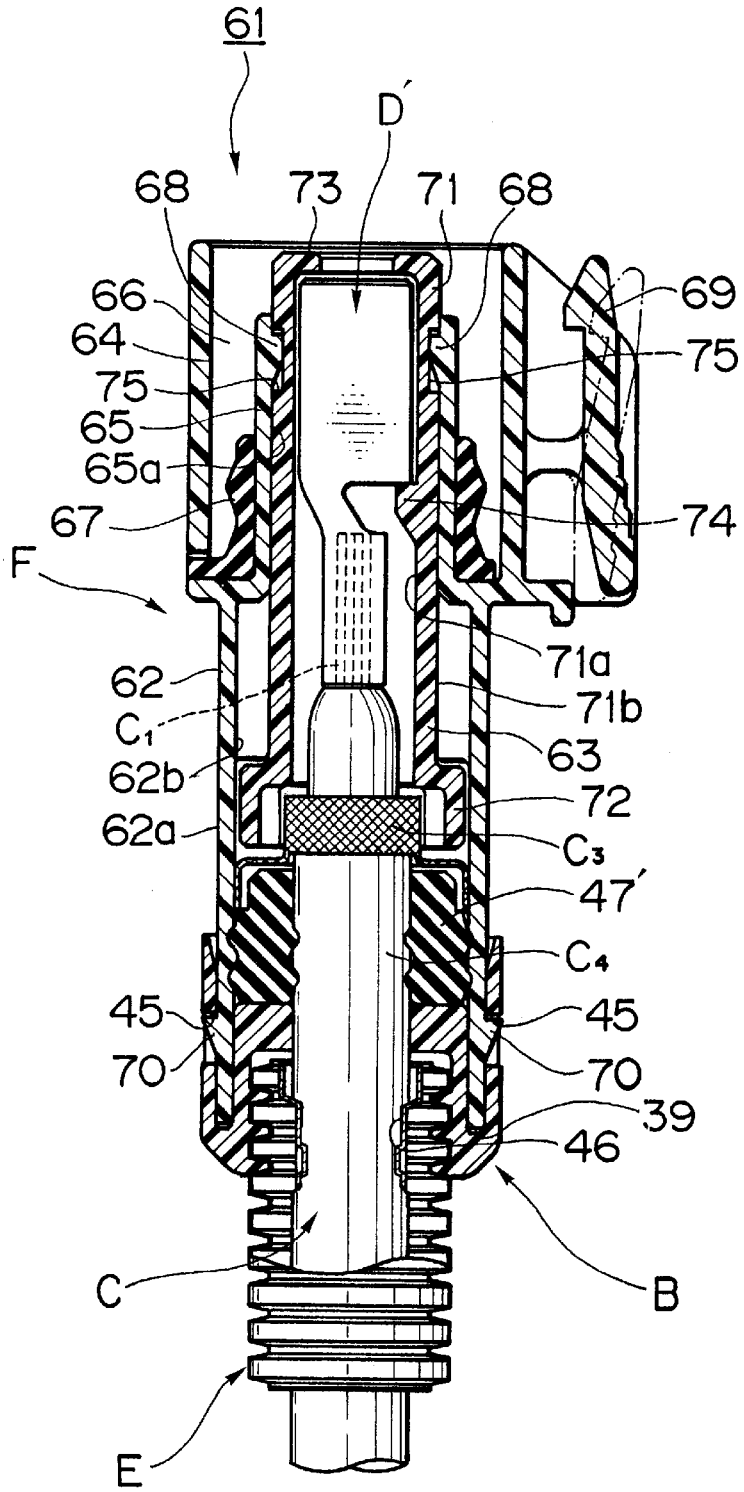
FIG. 10 is a sectional view of another embodiment of the shielded connector in accordance with the present invention.
Figure 11:
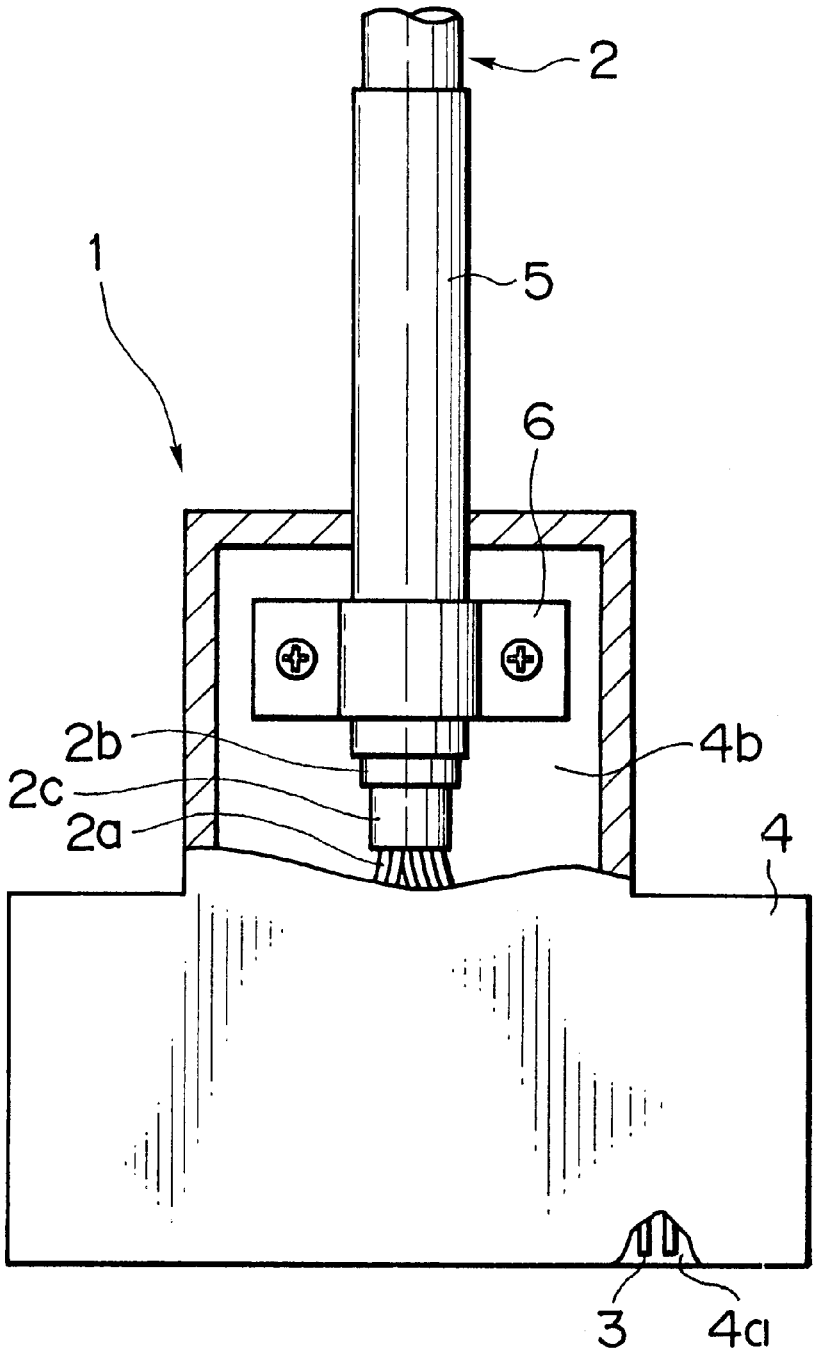
FIG. 11 PRIOR ART
FIG. 11 is a front view of a shielded connector in the prior art.
Figure 12:
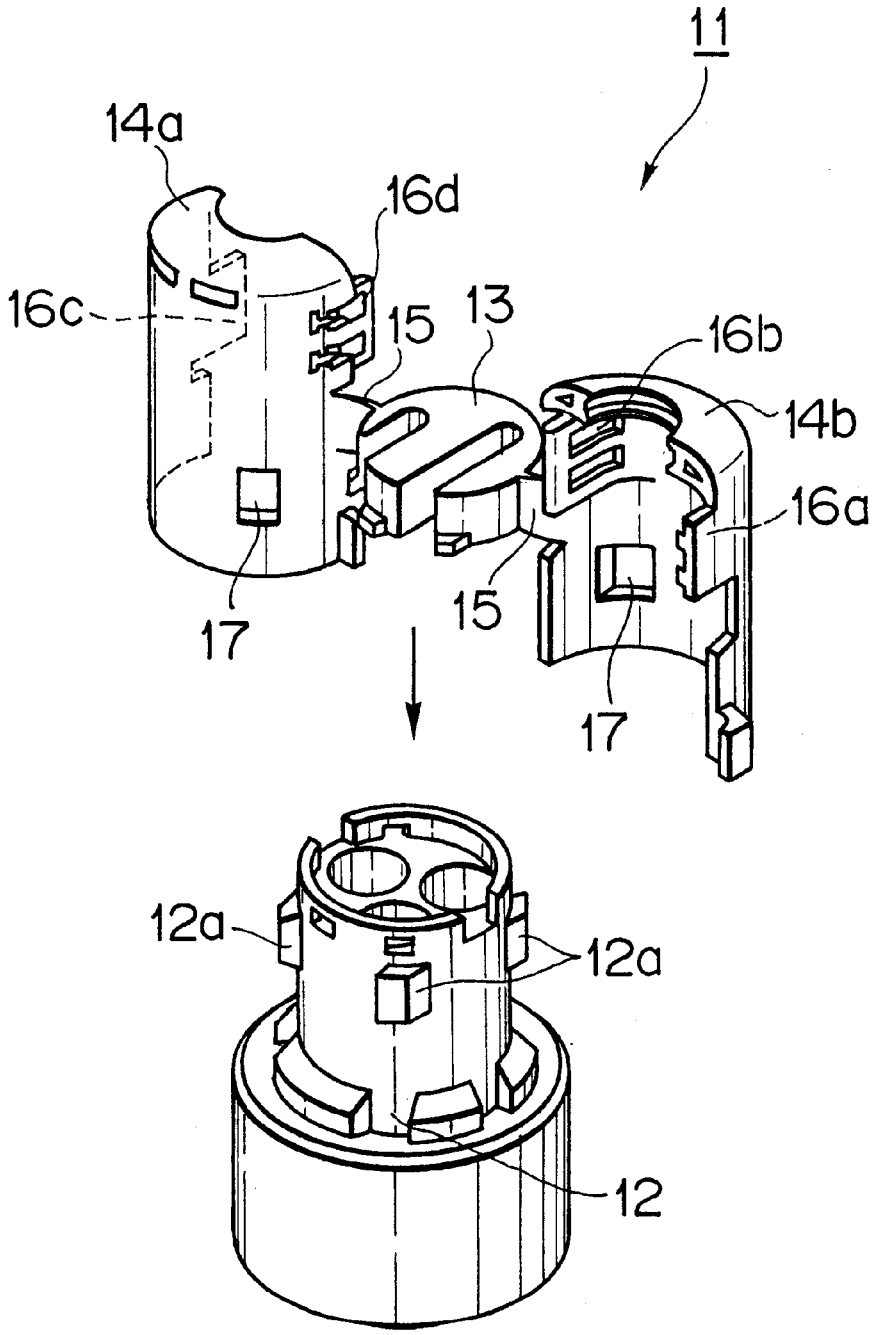
FIG. 12 PRIOR ART
FIG. 12 is an exploded perspective view of the rear holder cover in the prior art.
Figure 13:
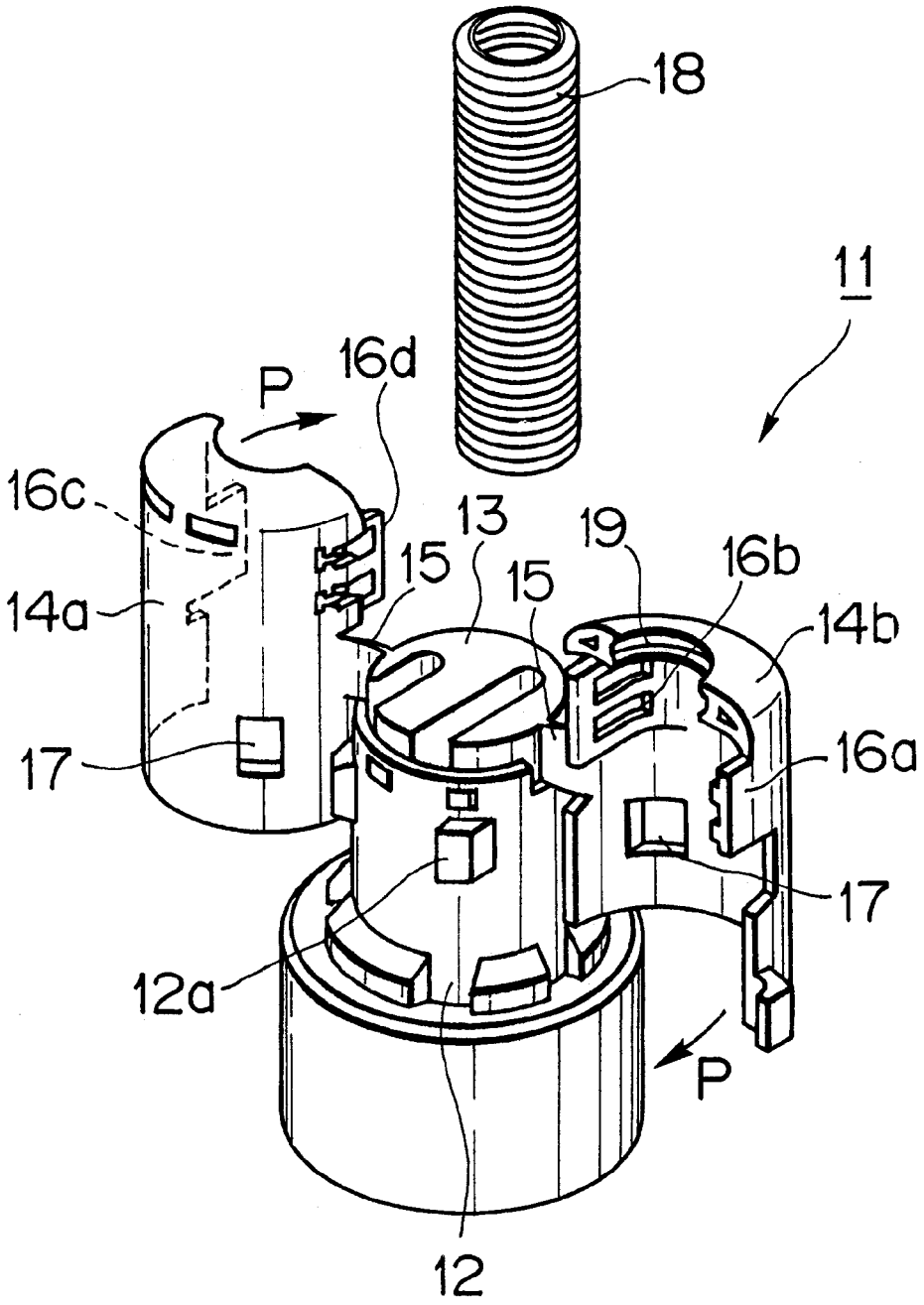
FIG. 13 PRIOR ART
FIG. 13 is a perspective view illustrating the assembling of the rear holder cover of FIG. 12.

FIG. 10 shows another embodiment of the shielded connector of the present invention. The shielded connector 61 includes a connector case F instead of the wire attachment case A. The other components are substantially the same as in the shielded connector 21, and the following is a description of the connector F.

The connector case F comprises an outer case 62 made of synthetic resin, and an inner case 63 also made of synthetic resin. Each of them takes a cylindrical shape with both ends open. The outer case 62 and the inner case 63 are both provided with conductive metal plating.

The outer case 62 has an expanding hood 64 for receiving a mating connector (not shown) in the front. The hood 64 internally has a cylindrical partition wall 65 corresponding to the casing of the mating connector. The partition wall 65 and the hood 64 constitute a receiving chamber 66 on the outside of the partition wall 65. The receiving chamber 6 is provided with a packing 67 made of silicon rubber. Stopper protrusions 68 for the inner case 63 protrude from the edge portion of the inner periphery surface 65*a* of the partition wall 65. Reference numeral 69 indicates a locking arm for locking the mating connector.

Securing protrusions 70 facing to each other for the securing holes 45 of the corrugated holder B are formed on the outer periphery wall 62*a* of the outer case 62.

The inner case 63 is made up of a small terminal stopper 71, a large guided portion 72 for the inner periphery wall 62*b* of the outer case 62, and a step portion. A stopper 73 is formed at the edge of the terminal stopper 71, and a terminal stopper protrusion 74 is formed in the middle of the inner wall 71*a*. Stopper holes 75 for the stopper protrusions 68 on the outer case 62 are formed in the front of the outer wall 71*b* of the terminal stopper 71.

In the above structure, the connector case F is formed by inserting the inner case 63 into the outer case 62 from the rear side. The stopper protrusions 68 are engaged with the stopper holes 75, so that the front of the outer wall 71*b* of the terminal stopper 71 is held by the partition wall 65.

The shield wire C has the sheath $C_4$ with the sheath holding ring 46 and the rubber stopper 47', and a conventional female connector terminal D' is bonded to the inner conductor $C_1$. The edge of the braid $C_3$ is bent outward, and part of the bent portion is sandwiched by the outer case 62 and the rubber stopper 47' in the assembling process of the shielded connector 61.

The corrugated holder B engaged with the shield wire C and the corrugated tube E is attached to the connector case F, so that the connector terminal D' inserted into the outer case 62 from the rear side is secured by the stopper 73 and the terminal stopper protrusion 74. The case insertion chamber 39 of the corrugated holder B is attached to the rear end of the outer case 62, and the securing protrusions 70 are engaged with the securing holes 45.

As described above, the corrugated holder B is engageable not only with the wire attachment case A but also with the connector case F. As with the shielded connector 21, the shielded connector of this embodiment can reduce production costs and prevent displacement of the sheath and other components.

The shield wire C is used in the above embodiments, but a collective wire such as a wire harness may also be employed. The sheath holding ring 46 is effective in preventing displacement of the wires. The wire stopper protrusion 40 may also be a ring-like protrusion, and the protruding edge preferably forms a curved surface corresponding to the outer surface of the shield wire C. Since the half covers 36 has a simple split-mold structure, the hinges connecting the half covers 36 never complicate the split-mold structure.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A shielded connector comprising:

a connector terminal connected to an end of a shield wire;

a wire attachment case, arranged for securement to an attachment opening of a casing of electric equipment to accommodate and protect the shield wire;

a corrugated holder attached to a wire insertion side of the wire attachment case;

corrugated tube connected to the wire insertion side of the wire attachment case via the corrugated holder to protect the shield wire;

said corrugated holder having a pair of half covers facing to each other, each of the half covers being provided with an outer cover portion and an inner cover portion;

a case insertion chamber disposed between the outer cover portion and the inner cover portion on the wire insertion side of the wire attachment case;

a wire stopper for the shield wire at one end of an inner surface of the inner cover portion;

a plurality of tube insertion grooves engaged with the corrugated tube at the other end of the inner surface of the inner cover portion; and a cover securing portion corresponding to an outer wall of the wire attachment case, the cover securing portion being provided to the outer cover portion.

2. The shielded connector according to claim 1, wherein a sheath holding ring is provided to a sheath of the shield wire to compress the sheath in the radial direction.

3. The shielded connector according to claim 2, wherein the sheath holding ring has a small caulking portion and a large stopper with a step portion, and an open rim of the large stopper has a diameter large enough to interfere with the wire stopper of the corrugated holder.

4. The shielded connector according to claim 1, wherein a rubber stopper which can be engaged with the wire stopper is attached to the shield wire.

5. The shielded connector according to claim 4, wherein the wire stopper is held between the sheath holding ring and the rubber stopper attached to the shield wire.

6. The shielded connector according to claim 1, wherein the wire stopper is made up of a plurality of protrusions situated at equal intervals and protruding toward the axis of the corrugated holder.

7. The shielded connector according to claim 1, wherein the wire stopper is a ring-like protrusion for holding the shield wire.

8. The shielded connector according to claim 1, wherein an inner coating of the shield wire extends from an opening at the connector terminal connecting side of the wire attachment case, and the inner coating is provided with an inner coating holding ring having a flange which is capable of interfering with the opening at the connector terminal connecting side of the wire attachment case.

9. The shielded connector according to claim 8, wherein the inner coating holding ring also serves as a stopper to prevent a shell member having electrical continuity to the braid of the shield wire from moving toward the connector terminal side of the wire attachment case.

10. The shielded connector according to claim 8, wherein the inner coating holding ring is made of an insulating material.

11. The shielded connector according to claim 9, wherein the inner coating holding ring is made of an insulating material.

12. A shielded connector comprising:

a connector terminal connected to an end of a shield wire, an inner case for accommodating and securing the connector terminal;

an outer case for covering the inner case and the end of the shield wire, the outer case being connected to a mating connector;

a corrugated holder attached to a wire insertion side of the outer case;

a corrugated tube for protecting the shield wire connected to the wire insertion side of the outer case via the corrugated holder;

said corrugated holder having a pair of half covers facing to each other,;

an outer cover portion and an inner cover portion provided to each of the half covers;

a case insertion chamber between the outer cover portion and the inner cover portion on the wire insertion side of the outer case;

a wire stopper for the shield wire provided at one end of an inner surface of the inner cover portion;

a plurality of tube insertion grooves for engaging the corrugated tube at the other end of the inner cover portion; and a cover securing portion corresponding to an outer wall of the outer case, the outer securing portion being provided to the outer cover portion.

13. The shielded connector according to claim 12, wherein the shield wire is provided with a sheath holding ring which radially compresses the sheath.

14. The shielded connector according to claim 13, wherein the sheath holding ring comprises a small caulking portion and a large stopper with a step portion, and an opening at an end of the stopper has a diameter large enough to interfere with the wire stopper of the corrugated holder.

* * * * *